United States Patent [19]

Nagy, Jr. et al.

[11] Patent Number: 4,695,497

[45] Date of Patent: Sep. 22, 1987

[54] METHOD OF IMPARTING STAIN RESISTANCE TO COLORED SUBSTRATES WHICH INCLUDE A FILAMENTARY MATERIAL

[75] Inventors: Monte L. Nagy, Jr., Chesterfield; Charles J. Cole, Chester, both of Va.

[73] Assignee: Allied Corporation, Morris Township, Morris County, N.J.

[21] Appl. No.: 263

[22] Filed: Jan. 2, 1987

[51] Int. Cl.[4] ..... B32B 3/02; B32B 33/00

[52] U.S. Cl. ..... 428/96; 427/393.4; 427/394; 427/412; 427/421; 428/97; 428/267; 428/290; 428/395; 428/421; 428/422

[58] Field of Search ..... 428/96, 97, 267, 290, 428/395, 421, 422; 427/412, 421, 393.4, 394

[56] References Cited

U.S. PATENT DOCUMENTS 4,643,930 2/1987 Ucci ..... 428/96

*Primary Examiner*—Marion C. McCamish

*Attorney, Agent, or Firm*—Richard A. Anderson

[57] ABSTRACT

A method of imparting stain resistance to colored substrates which include a filamentary material is disclosed. A first dispersion of a polymer is applied to the filamentary material as a finish during the manufacture of the filamentary material, and a second dispersion of a polymer is applied as an overspray after the filamentary material has been formed into a colored substrate, to achieve at least 300 ppm fluorine from each application on the filamentary material (at least 600 ppm fluorine total). The dispersions are independently selected from the group consisting of i. a first polymer comprising (a) from about 50 to about 85 parts by weight of units derived from a fluorinated monomer or mixture of fluorinated monomers having the formula

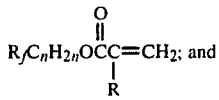

(b) from about 15 to about 50 parts by weight of units derived from one or more monomers having the formula

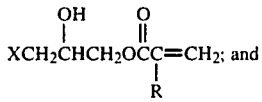

ii. a dispersion comprising (a) from about 10 to about 50 parts by weight the first polymer;

(b) from about 5 to about 10 parts by weight an emulsifier; and (c) from about 40 to 85 parts by weight a second polymer derived from a monomer having the formula

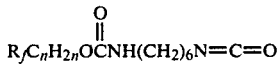

wherein $R_f$ is straight or branched-chain perfluoroalkyl containing 4–20 carbon atoms;

R is H or $CH_3$;

n is an integer from 1–15; and

X is Cl or Br.

19 Claims, No Drawings

METHOD OF IMPARTING STAIN RESISTANCE TO COLORED SUBSTRATES WHICH INCLUDE A FILAMENTARY MATERIAL

BACKGROUND OF THE INVENTION

1. Field of the Invention

This invention relates to a method of imparting stain resistance to colored substrates which include a cut filamentary material, and more particularly to improving the stain resistance of dyed carpets of nylon 6.

2. The Prior Art

The treatment of textiles with fluorochemicals to impart oil repellency and soil resistance has been known for some time. Some of the fluorochemicals used are taught by, e.g., U.S. Pat. Nos. 4,209,610 to Mares et al. and 4,604,316 to Thomas et al., both of which are hereby incorporated by reference. Emulsification systems for the fluorochemicals for incorporation with yarn via a yarn finish are taught by, e.g., U.S. Pat. Nos. 4,192,754 to Marshall et al. and 4,317,736 to Marshall et al., both of which are hereby incorporated by reference. Fluorochemical application by overspraying carpets or other finished goods with, e.g., Teflon® or Scotchgard® brand of fluorochemical, is also well known. These two types of treatments, however, typically are carried out independent of one another, the prior art mentioning their use in the alternative. See for example European Patent Publication No. 0 124 236 to Korzeniowski et al., hereby incorporated by reference, wherein the fluorine-containing acrylic copolymer of the present invention is shown to be applicable to textile filaments as a spin finish during filament manufacture, or to substrates as a stable aqueous dispersion by conventional techniques, such as spraying, dipping, padding, roller-coating, or exhaustion techniques.

The present invention was developed during continuing research into treatment of substrates with fluorochemicals.

SUMMARY OF THE INVENTION

The method of the present invention imparts stain resistance to a colored substrate comprising a filamentary material. The method comprises the steps of applying a first dispersion of a polymer as a finish to a filamentary material during manufacture thereof, forming the filamentary material into a colored substrate, and applying a second dispersion of a polymer to the filamentary material. Each dispersion is applied in an amount sufficient to achieve at least 300 ppm fluorine per application on the filamentary material.

The term "filamentary material" is employed in the general sense to indicate strand material, either textile or otherwise, and including a continuous, often plied strand composed of fibers or filaments, or a noncontinuous strand such as staple, and the like. The term also is meant to include fiber, such as continuous single filaments, of a yarn or individual strands of staple fiber before drafting and spinning into a conventional staple yarn. The term "substrate" is likewise used in a general sense to indicate the end use of the filamentary material, and includes fabrics used in apparel, upholstery, draperies, and similar applications, as well as carpets. Carpets are the preferred substrate. By "colored" is meant the filamentary material is pigmented or predyed with acid dyes, or the filamentary material is dyed after formation into the substrate. Substrates with patterns where a portion of the filamentary material is not colored are meant to be included in this definition.

The filamentary material may be made from synthetic organic polymer, which generally includes any fiber-forming thermoplastic resin such as polyamide, polypropylene, polyester, polyacrylanitrile and blends thereof, preferably the former. The term "polyamide" denotes those synthetic long chain polyamides having recurring amide groups as an integral part of the polymer chain. Exemplary of such polyamides are nylon 6, nylon 66, and nylon 12.

The first and second dispersions can be selected independently from a group of two dispersions. One of the dispersions is a first polymer which comprises (a) from about 50 to 85 parts by weight of units derived from a fluorinated monomer or mixture of fluorinated monomers having the formula

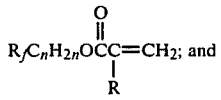

$$R_fC_nH_{2n}OC(=O)C(R)=CH_2;\ \text{and}$$

(b) from about 15 to about 50 parts by weight of units derived from one or more monomers having the formula

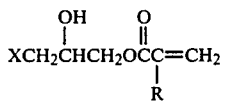

$$XCH_2CH(OH)CH_2OC(=O)C(R)=CH_2$$

wherein $R_f$ is straight or branched-chain perfluoroalkyl containing 4–20 carbon atoms;

R is H or $CH_3$;

n is an integer from 1–15; and

X is Cl or Br.

Preferably, this first polymer contains between 65 and 75 parts by weight of units derived from the fluorinated monomer or mixture of fluorinated monomers and 25 to 35 parts by weight of units derived from 3-chloro-2-hydroxypropyl methacrylate and/or acrylate. The preferred first polymer of the invention, as shown in the examples, consists essentially of 75 weight percent of a mixture of the fluorinated monomers (a) and 25 weight percent of 3-chloro-2-hydroxypropyl methacrylate. Also of interest is the first polymer consisting essentially of 65 weight percent of a mixture of the fluorine-containing monomers (a) and 35 weight percent of 3-chloro-2-hydroxypropyl methacrylate.

The most preferred fluorinated monomers are those wherein R is $CH_3$ and $R_f$ is a mixture of perfluoroalkyl groups, $CF_3CF_2(CF_2)X$ in which X is 2, 4, 6, 8, 10 and 12 in the approximate weight ratio of 2/35/30/18/8/3. Such a mixture of monomers has a weight average molecular weight of 522. See U.S. Pat. Nos. 3,282,905 to Fasick et al.; 4,147,851 to Raynolds, and 3,645,989 to Tandy, all of which are hereby incorporated by reference. The 3-chloro-(or 3-bromo-)2-hydroxypropyl acrylate or methacrylate monomer can be prepared by a variety of known techniques. See, for example, U.S. Pat. Nos. 3,799,915 to Dunnavant et al., and 2,567,842 to Erickson, both of which are hereby incorporated by reference.

The first polymers of the present invention can be prepared by the use of well known polymerization techniques and conditions. Typically, a mixture of the monomers in an inert solvent is polymerized in the presence of a free-radical initiator and a chain transfer agent. Any conventional neutral solvent such as methyl isobutyl ketone, methyl ethyl ketone, methyl n-amyl ketone, 1,1,2-trifluoro-1,2,2-trichloroethane, xylene, and the like and mixtures thereof can be used, with methyl isobutyl ketone being preferred. Conventional free-radical initiators such as peroxy compounds and azo compounds which are soluble in the solvent system can used, e.g., 2,2'-azo-bis(2-methylbutanenitrile), 2,2'-azo-bis(2-methylpropanenitrile), benzoyl peroxide, and the like. Initiator concentration can be between about 1 and 6 percent based on the total weight of monomers. Likewise, conventional chain transfer agents, such as dodecylmercaptan, isooctyl thioglycolate, and the like, in amounts between about 1 and 10 percent by weight of the total weight of the monomers, can be used to control the molecular weight of the polymers. The reaction must be carried out at a temperature which is at least sufficient to assure that the fluorinated monomer is molten; typically, temperatures between 60 and 160° C. are used.

The other dispersion of the present invention comprises (a) from about 10 to about 50 parts by weight of the first polymer, just discussed; (b) from about 5 to about 10 parts by weight an emulsifier; and (c) from about 40 to 85 parts by weight a second polymer derived from a monomer having the formula $$R_fC_nH_{2n}O\overset{\overset{\displaystyle O}{\|}}{C}NH(CH_2)_6N{=}C{=}O$$

wherein $R_f$ and n are as described for the first polymer.

The emulsifier preferably comprises a triethylammonium alkyl chloride wherein the alkyl group is selected from the group consisting of cetyl, stearyl, and a mixture thereof.

The second polymer preferably comprises three monomeric units which form under basic conditions a cyclic S-triazine trione having the structure

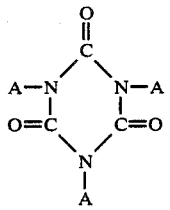

wherein A comprises $$R_fC_nH_{2n}O\overset{\overset{\displaystyle O}{\|}}{C}NH(CH_2)_6{-}$$

and $R_f$ and n are as defined above.

When applied as a finish composition, the fluorochemical preferably is emulsified and this emulsion (dispersion) is applied during spinning of the yarn. The emulsion may include a conventional spin finish, or a conventional spin finish may be applied to the yarn just prior to or subsequent to application of the emulsified fluoro-chemical, e.g., by tandem or in series kiss rolls. The emulsion could alternatively be applied as an overfinish during beaming of the yarn. Staple fiber could be treated by spraying. Fabric or carpet made from fiber can be treated with the emulsion by spraying, padding, or dipping in a conventional manner subsequent to formation of the substrate. Overspray subsequent to dyeing is a preferred treatment.

The present invention is also directed to carpet made in accordance with the described method.

DESCRIPTION OF THE PREFERRED EMBODIMENT

In this description and in the examples which follow, all parts are by weight and temperatures are in degrees centigrade unless otherwise indicated. The weight percentages of monomer units in the polymers are based on the weights of monomers charged to the reaction.

The preferred fluorochemical compounds which are useful in the yarn finish composition and overspray of the present invention are commercially available as MPD 5737 and MPD 6202 from E. I. duPont de Nemours & Company.

The first polymer of the invention is described in European Patent Application Publication No. 0 124 236 Al, hereby incorporated by reference. The 3-chloro-2-hydroxypropyl methacrylate was prepared as follows. To a 250-ml three-necked flask with a heating mantle, agitation means, thermometer, nitrogen sweep and reflux condenser topped with a nitrogen bubbler were charged the following:

| Ingredient | Amount of Ingredient, g |
|---|---|
| glacial methacrylic acid | 86.09 |
| epichlorohydrin | 83.28 |
| benzyltriethylammonium chloride | 8.6 |
| methanol | 21.4 |

With agitation, nitrogen flow and condenser water on, the mixture was heated to 45±5° and held overnight (about 17 hours). Thereafter, the reaction mixture was permitted to cool to room temperature (about 25° C.) and was washed with a mixture of 5% aqueous sodium bicarbonate (250 ml) and ethyl acetate (200 ml). The upper organic layer was separated, and the aqueous layer was washed three times with 100 ml of ethyl acetate. All of the ethyl acetate layers were combined and washed twice with 200 ml of 5% sodium bicarbonate and five times with 200 ml of deionized water. The ethyl acetate layer was dried over 75 g sodium sulfate overnight (16–17 hours). Most of the ethyl acetate was evaporated in a Rotovap device, and then under 10 mm Hg vacuum for an hour and a half to give 128.45 g of a clear, colorless, somewhat viscous liquid. This was stored in a freezer until needed for copolymerization.

A polymerization was run using the above-described 3-chloro-2-hydroxypropyl methacrylate (15.65 g) and a mixture of fluorinated methacrylates (46.88 g of Zonyl TM, commercially available from E. I. Dupont de Nemours & Company, and purified in accordance with the manufacturer's recommendation) and a mixture of fluorinated methacrylates having the formula $$CF_3CF_2(CF_2)_XC_2H_4O_2CC(CH_3){=}CH_2$$

wherein X is 2, 4, 6, 8, 10 and 12 in the respective relative amounts of 2:35:30:18:8:3. Azo-bis-isobutyronitrile (1.07 g) was used as a free-radical initiator and dodecyl mercaptan (1.88 g) was used as a chain transfer agent. The fluorinated methacrylates, 3-chloro-2-hydroxypropyl methacrylate, dodecyl mercaptan and 75 g of methyl isobutyl ketone were charged to a three-necked, 250-ml flask, and at room temperature, the mixture was sparged for an hour with argon. The mixture was heated with agitation under argon to about 66° for overnight (about 16 hours). It was then heated to 90° and held there for one hour, after which it was cooled to room temperature. The polymerization run gave a clear 136.26 g solution, 45.5% solids; reduced viscosity was measured to be 0.04 d/g. In this manner was prepared 1,1,2,2-tetrahydroperfluoroalkyl methacrylate/3-chloro-2-hydroxypropyl methacrylate copolymer (the first polymer).

An aqueous dispersion of this copolymer can be formed with conventional cationic or anionic dispersing agents. The commercially available dispersion, which is cationic and contains about 20% solids, 45% fluorine, is believed to be made in a similar fashion.

EXAMPLES 1-8

Nylon 6 polymer pellets were melt extruded under pressure through a spinnerette to produce an undrawn yarn. For Example 1, spin finish A of Table 1 was conventionally applied to the yarn to achieve a 4-6% wet pickup. The yarn was then drawn and textured to produce a bulked yarn that is particularly useful for production of carpets and upholstery fabrics. This yarn was formed into a 32 oz/yd$^2$ cut pile carpet. Example 1 is deemed the control.

The procedure of Example 1 was repeated utilizing spin finish B of Table 1 in Examples 2A-2C to achieve 300,400 and 500 ppm fluorine, respectively, on the yarn, which was subsequently formed into a carpet.

In Examples 3A-8, the procedure of Example 1 was repeated utilizing the spin finishes listed in Table 2 and details of which are found in Table 1.

All of the carpets were acid dyed in a beck in a conventional manner to a soiling yellow using the formulation: 0.0061% on weight of fabric (OWF hereafter) Tectilon Red 2B (100% strength), 0.004% OWF Tectilon Blue 4R (100% strength), and 0.020% OWF Tectilon Yellow 4R (250% strength). Subsequent to dyeing and drying, the carpets of Examples 3A-8 were oversprayed using conventional equipment in a conventional manner to achieve minimally the targeted amounts of fluorine shown in Table 2. The oversprays utilized were; 1. aqueous dispersion of first polymer of the invention, 2. aqueous dispersion of Teflon®, 3. aqueous dispersion of Scotchgard® 391, and 4. aqueous dispersion of first and second polymers of the invention.

Samples of each of the carpets of Examples 1-8 were stained as follows. 30 ml of a solution were poured onto the carpet area from 2 inches above the surface. The solution was left on the surface for three minutes, after which it was blotted (no mechanical action) with paper towels. The samples were allowed to dry overnight. There were three different staining solutions used in each example: 100% Gallo brand burgundy wine, non-sweetened cherry Kool-Aid® made according to manufacturer's suggestion, and Maxwell House ADC coffee with sugar (100 ml per 1000 ml water). The carpets were evaluated with respect to size, penetration and intensity of the stain. Based on this evaluation, they were ranked for stain resistance on a scale of 1-7 with 1 representing very good stain resistance and 7 representing practically no stain resistance. Results are presented in Table 2.

These carpet samples were all then steam cleaned three times. The cleaned carpets were then reevaluated for stain resistance and ranked. Carpets of Examples 4 and 7 retained original stain resistance performance. The rankings were the same as prior to cleaning, and are presented in Table 2.

Surprisingly, it has been found that the two-step fluorochemical application comprising the present invention is superior to the two-step fluorochemical application of some of the other examples (see Examples 5 and 6). The stain resistance demonstrated by Examples 4 and 7 clearly was more than additive (See Examples 2A-2C, 3A, 3A', 3D and 3D').

Tests for retention of the fluorine antisoil agent and for determining the fluorides are delineated in U.S. Pat. No. 4,591,473 to Lofquist et al., hereby incorporated by reference.

EXAMPLES 9 AND 10

Molten polycaproamide polymer was supplied to a spinnerette from which a plurality of filaments were extruded into a quench stack for quenching. The filaments were lubricated with spin finish B in Example 9 and with spin finish C in Example 10, both found in Table 1, at about 4 to 6 percent wet pickup and subsequently were conventionally, textured and cut into staple yarn. The cut staple yarn was made into 32 oz/yd$^2$ cut pile carpets by conventional means. The carpets had a target fluorine application on finished goods of 300 ppm. In Example 9, the first carpet was dyed and oversprayed with overspray No. 1 targeting fluorine application on finished goods of 300 ppm to give a total of 600 ppm fluorine, as in Example 4 above. In Example 10, the second carpet was dyed and oversprayed with overspray No. 4, as in Example 8 above. These carpets were also tested for stain resistance as in the prior examples and performed as well as the carpets of Examples 4 and 8, respectively.

EXAMPLE 11

Polyethylene terephthalate pellets are melted and melt extruded under pressure through a spinnerette to produce a partially oriented yarn. Spin finish B of Table 1 is applied to the yarn which is then draw-textured to produce a bulked yarn. Yarn produced in this manner is particularly useful for production of carpets. Carpet made from yarn prepared in accordance with this example, and subsequently dyed and oversprayed as in Example 4 heretofore, is expected to be effective in resisting stains.

EXAMPLE 12

Polyethylene terephthalate pellets are melted and melt extruded under pressure through a spinnerette to produce a partially oriented yarn. Spin finish C of Table 1 is applied to the yarn which is then draw-textured to produce a bulked yarn. Yarn produced in this manner is particularly useful for production of carpets. Carpet made from yarn prepared in accordance with this example, and subsequently dyed and oversprayed as in Example 8 heretofore, is expected to be effective in resisting stains.

TABLE 1

| SPIN FINISH | | | |
|---|---|---|---|
| | Percent | | |
| Components | A | B | C |
| Fluorochemical Dispersion | — | 16.0[1] | 16.38[2] |

TABLE 1-continued

| SPIN FINISH | | | |
|---|---|---|---|
| | Percent | | |
| Components | A | B | C |
| Water | 85–87 | 69–72 | 71.62 |
| Noncontinuous Phase[3] | 12–15 | 12–15 | 12 |

[1]Cationic aqueous dispersion of first polymer of detailed description.
[2]MPD 6202, commercially available from E. I. duPont de Nemours & Company, cationic aqueous dispersion, 20% solids of which 40% is fluorine.
[3]Lubricants, emulsifiers, wetting agents, optionally antistat; makeup may vary from example to example.

TABLE 2

| TARGET FLUORINE APPLICATION (ppm) ON FINISHED GOODS | | | | | | |
|---|---|---|---|---|---|---|
| Example | Spin Finish | On Yarn[1] | Over-Spray[2] | On Substrate[3] | Total[4] | Ranking |
| 1 | A | — | No | — | — | 7 |
| 2A | B | 300 | No | — | 300 | 5 |
| 2B | B | 400 | No | — | 400 | 5+ |
| 2C | B | 500 | No | — | 500 | 5+ |
| 3A | A | — | 1 | 500 | 500 | 6 |
| 3A' | A | — | 1 | 1500 | 1500 | 6 |
| 3B | A | — | 2 | 300 | 300 | 6 |
| 3C | A | — | 3 | 500 | 500 | 6 |
| 3C' | A | — | 3 | 1500 | 1500 | 6 |
| 3D | A | — | 4 | 500 | 500 | 6 |
| 3D' | A | — | 4 | 1500 | 1500 | 6 |
| 4 | B | 300 | 1 | 300 | 600 | 1 |
| 5 | B | 300 | 2 | 300 | 600 | 3 |
| 6 | B | 300 | 3 | 300 | 600 | 3 |
| 7 | B | 300 | 4 | 300 | 600 | 1 |
| 8 | C | 300 | 4 | 300 | 600 | 2 |

[1]from spin finish.
[2]identified as follows:
1. aqueous dispersion of first polymer of invention.
2. aqueous dispersion of Teflon ®.
3. aqueous dispersion of Scotchguard ® 391, commercially available from 3M.
4. aqueous dispersion of first and second polymers of invention (see footnote 2 in Table 1).
[3]from overspray.
[4]combination of 1 and 2.

We claim:

1. A method of imparting stain resistance to a colored substrate comprising a filamentary material, said method comprising:

a. applying a first dispersion of a polymer as a finish to a filamentary material during manufacture thereof;

b. forming the filamentary material into a colored substrate; and c. applying a second dispersion of a polymer to the filamentary material; each of said dispersions being applied in an amount sufficient to achieve at least 300 ppm fluorine from each application on the filamentary material, said first and second dispersions being independently selected from the group consisting of:

i. a first polymer comprising (a) from about 50 to about 85 parts by weight of units derived from a fluorinated monomer or mixture of fluorinated monomers having the formula

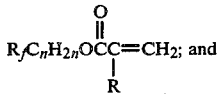

$R_fC_nH_{2n}OC(=O)C(R)=CH_2$; and (b) from about 15 to about 50 parts by weight of units derived from one or more monomers having the formula

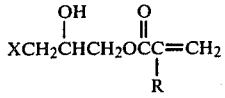

$XCH_2CH(OH)CH_2OC(=O)C(R)=CH_2$ wherein $R_f$ is straight or branched-chain perfluoroalkyl containing 4–20 carbon atoms;

R is H or $CH_3$;

n is an integer from 1–15; and

X is Cl or Br; and ii. a dispersion comprising (a) from about 10 to 50 parts by weight said first polymer;

(b) from about 5 to about 10 parts by weight an emulsifier; and (c) from about 40 to 85 parts by weight a second polymer derived from a monomer having the formula

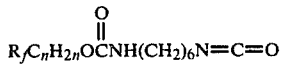

$R_fC_nH_{2n}OC(=O)NH(CH_2)_6N=C=O$ wherein $R_f$ is straight or branched-chain perfluoroalkyl containing 4–20 carbon atoms; and n is an integer from 1–15.

2. The method of claim 1 wherein the second polymer comprises three monomeric units which form a cyclic S-triazine trione having the structure

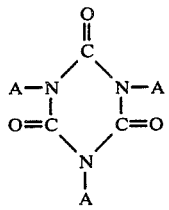

wherein A comprises

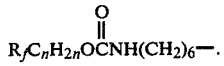

$R_fC_nH_{2n}OC(=O)NH(CH_2)_6-$.

3. The method of claim 2 wherein the emulsifier comprises a triethylammonium alkyl chloride and wherein the alkyl group is selected from the group consisting of cetyl, stearyl, and a mixture of cetyl and stearyl.

4. The method of claim 3 wherein said filamentary material is nylon.

5. A carpet made in accordance with the method of claim 4.

6. The method of claim 1 wherein R is $CH_3$ and $R_f$ is a mixture of perfluoroalkyl groups having the formula $CF_3CF_2(CF_2)_X$ in which X is 2, 4, 6, 8, 10 and 12 in the approximate relative quantities by weight of 2/35/30/18/8/3.

7. The method of claim 6 wherein said filamentary material is nylon.

8. A carpet made in accordance with the method of claim 7.

9. The method of claim 1 wherein said filamentary material is nylon.

10. The method of claim 6 wherein said first polymer contains between about 65 and 75 parts by weight of units derived from said fluorinated monomer or mixture of fluorinated monomers and between 25 and 35 parts by weight of units derived from 3-chloro-2-hydroxypropyl methacrylate and/or acrylate.

11. The method of claim 10 wherein R is $CH_3$ and $R_f$ is a mixture of perfluoroalkyl groups having the formula $$CF_3CF_2(CF_2)_X$$

in which X is 2, 4, 6, 8, 10 and 12 in the approximate relative quantities by weight of 2/35/30/18/8/3.

12. The method of claim 11 wherein said filamentary material is nylon.

13. A carpet made in accordance with the method of claim 12.

14. The method of claim 10 wherein said filamentary material is nylon.

15. The method of claim 10 wherein said first polymer contains about 75 weight percent of units derived from a mixture of said fluorinated monomers and about 25 weight percent of units derived from 3-chloro-2-hydroxypropyl methacrylate.

16. The method of claim 15 wherein R is $CH_3$ and $R_f$ is a mixture of perfluoroalkyl groups having the formula $$CF_3CF_2(CF_2)_X$$

in which X is 2, 4, 6, 8, 10 and 12 in the approximate relative quantities by weight of 2/35/30/18/8/3.

17. A carpet made in accordance with the method of claim 16.

18. The method of claim 17 wherein said filamentary material is nylon.

19. The method of claim 1 wherein said second dispersion is applied by spraying onto the filamentary material.

* * * * *